United States Patent [19]

Balzer

[11] Patent Number: 4,736,764

[45] Date of Patent: Apr. 12, 1988

[54] PROCESS FOR TRANSPORTATION OF VISCOUS CRUDE OILS

[75] Inventor: Dieter Balzer, Haltern, Fed. Rep. of Germany

[73] Assignee: Huels Aktiengesellschaft, Marl, Fed. Rep. of Germany

[21] Appl. No.: 780,877

[22] Filed: Sep. 27, 1985

[30] Foreign Application Priority Data

Sep. 27, 1984 [DE] Fed. Rep. of Germany ..... 3435430

[51] Int. Cl.[4] ..... F17D 1/17

[52] U.S. Cl. ..... 137/13; 252/8.551; 252/312

[58] Field of Search ..... 137/13; 252/8.55 R, 252/312

[56] References Cited

U.S. PATENT DOCUMENTS

| | | | |
|---|---|---|---|
| 2,183,853 | 12/1939 | Haussman et al. | 562/587 X |
| 3,467,195 | 9/1969 | McAuliffe et al. | 252/8.55 X |
| 3,491,835 | 1/1970 | Gagle | 137/13 X |
| 4,249,554 | 2/1981 | McClaflin | 252/8.55 X |
| 4,265,264 | 5/1981 | Sifferman | 252/8.55 X |
| 4,285,356 | 8/1981 | Sifferman | 252/8.55 X |
| 4,457,373 | 7/1984 | Balzer et al. | 252/8.55 X |
| 4,478,281 | 10/1984 | Balzer et al. | 252/8.55 X |
| 4,485,873 | 12/1984 | Balzer et al. | 252/8.55 X |

OTHER PUBLICATIONS

"Heavy Crude Perspectives", Organization of the Petroleum Exporting Cuntries, Vienna, Austria DOE 10086-T1/1980, pp. 1-8, Table I-1.

*Primary Examiner*—Herbert B. Guynn
*Attorney, Agent, or Firm*—Millen & White

[57] ABSTRACT

A process for the transportation of viscous crude oils utilizes an emulsifier-containing oil-in-water emulsion having at least 10-15% water which is subsequently separated again into crude oil and water. The emulsifier is a carboxymethylated ethoxylate of the formula $$R—(O—CH_2—CH_2)_n—O—CH_2—COOM$$

wherein

R is a linear or branched aliphatic residue of 6-20 carbon atoms, or an alkyl- or dialkylaromatic residue of 5-16 carbon atoms per alkyl group, n is 1-40 and M is an alkali or alkaline earth metal ion, or ammonium.

11 Claims, No Drawings

PROCESS FOR TRANSPORTATION OF VISCOUS CRUDE OILS

BACKGROUND OF THE INVENTION

Heavy oils, under conditions of usual outside temperatures, can be transported only with difficulty in pipelines because of their very high viscosity. In order to raise their mobility, they are, therefore, frequently mixed with low-viscosity crude oils or with refinery cuts; such a mode of operation requires relatively high quantities of additives to obtain any marked improvement in flow. In addition, such a procedure is possible only where light-oil fields exist at the same site, or where a refinery in the vicinity can deliver low-viscosity gasoline fractions.

Another method that has also been employed resides in supplying heat to the heavy oil to lower its viscosity and correspondingly to improve fluidity. Considerable amounts of heat must be expended for this purpose. Thus, it is necessary, for example, to heat a heavy oil of 10.3° API, the viscosity of which at 20° C. is 40,000 mPa·s, to a temperature of about 95° C. for obtaining a viscosity of about 100 mPa·s, a threshold value frequently required for oil transportation in pipelines (M. L. Chirinos et al., Rev. Tec. Intevep 3 (2): 103 [1983]). This means extreme financial expenditures for equipping and supplying the pipelines, and a loss of 15–20% of crude oil, since customarily the necessary amount of heat is obtained by combustion of crude oil.

Another procedure for heavy oil transportation resides in pumping the oil through the pipelines in the form of a more or less readily fluid emulsion. Since the viscosity of emulsions is determined quite predominantly by that of the dispersant, an oil-in-water emulsion is involved here. The oil-in-water emulsion is produced by adding water and emulsifier to the oil using shear forces. This mixture is then pumped into the pipeline. The emulsion is thereafter separated into oil and water again in a settling tank, for example prior to entering the refinery. The thus-separated oil is introduced into the refinery. The emulsifier, at minimum concentration, should produce a stable, readily fluid oil-in-water emulsion with a very high proportion of oil. This naturally poses high requirements on the emulsifiers. High shear forces must likewise be avoided during emulsification since the danger exists of inversion into a water-in-oil emulsion that is extremely highly viscous in the case of crude oils. Furthermore, the emulsions should be stable with respect to relatively high salinities which occur in many deposit systems, as well as with respect to elevated temperatures. Moreover, despite exhibiting adequate stability while flowing through the pipeline, the emulsions are to be separable again with minimum problems. Sulfur-containing emulsifiers are undesirable unless it is possible to maintain them in the aqueous phase during the separating step.

The emulsifiers proposed heretofore do not as yet adequately fulfill the aforementioned conditions. In many cases (for example U.S. Pat. Nos. 4,285,356; 4,265,264; 4,249,554), emulsions have oil contents of merely 50%; this means that half of the pipeline volume is rendered useless. In other instances (for example Canadian Pat. Nos. 1,108,205; 1,113,529; 1,117,568; as well as U.S. Pat. No. 4,246,919), the reduction in viscosity attained by the addition of emulsifier is small, in spite of the relatively low oil proportion. And, finally, frequently, undesirable emulsifiers based on sulfur are utilized.

SUMMARY OF THE INVENTION

Therefore, it is an object of this invention to provide emulsifiers for the emulsification of heavy oil, e.g., for heavy oil transportation in pipelines, which emulsifiers do not exhibit the aforementioned disadvantages but rather correspond essentially to the above-described array of desirable properties.

Upon further study of the specification and appended claims, further objects and advantages of this invention will become apparent to those skilled in the art.

These objects have been attained by utilizing as the emulsifiers carboxymethylated ethoxylates of the formula $$R—(O—CH_2—CH_2)_n—O—CH_2—COOM$$

wherein

R is a linear or branched aliphatic residue of 6–20 carbon atoms, or an alkyl- or dialkylaromatic residue of 5–16 carbon atoms per alkyl group, n is 1–40 and M is an alkali or alkaline earth metal ion, or ammonium.

DETAILED DESCRIPTION

Advantageously, the carboxymethylated ethoxylates are produced according to German Pat. No. 2,418,444, which disclosure is incorporated by reference herein, by reacting ethoxylates of the formula $$R—(O—CH_2—CH_2)_n—OH$$

with chloroacetic acid or a salt of chloroacetic acid, in the presence of alkali metal hydroxide or alkaline earth metal hydroxide. However, other preparation methods are likewise suitable.

These emulsifiers are the subject of several other oil-related used disclosed in commonly assigned U.S. Pat. Nos. 4,478,281, 4,457,373, 4,485,873 and U.S. application Ser. No. 633,680 of July 25, 1984, now U.S. Pat. No. 4,542,790 (a C-I-P of Ser. No. 300,547 of Sept. 9, 1981), now abandoned all of which disclosures are incorporated by reference herein.

Preferably, R is a hydrocarbon saturated or unsaturated, straight-chain or branched, alkyl or alkenyl residue of 8–18 carbon atoms, or a hydrocarbon alkylaryl residue of 5–16 carbon atoms in the alkyl group, or a hydrocarbon dialkyl aryl residue of 3–16 carbon atoms per alkyl group. The aryl residue generally has 6–10 C-atoms, e.g., phenyl or naphthyl. Suitable as the alcohols, the ethoxylates of which are carboxymethylated, are, for example: hexyl alcohol, octyl alcohol, 2-ethylhexyl alcohol, nonyl alcohol, isononyl alcohol, decyl and undecyl alcohol, lauryl, tridecyl, myristyl, palmityl and stearyl alcohol, and also unsaturated alcohols, for example, oleyl alcohol and the like. Commercially available mixtures of these alcohols are also suitable. Examples for alkyl phenols that can be employed include: pentylphenol, hexylphenol, octylphenol, nonylphenol, dodecylphenol, hexadecylphenol, as well as the corresponding dialkyl phenols, e.g., dibutylphenol, dihexylphenol, etc. Also suitable are alkyl cresols and alkyl xylenols.

The ethoxylation can be performed in the presence of catalytic amounts of alkali metal hydroxide; however, as is known, other methods are also possible. The degree of ethoxylation (n) can assume values of 1 to 40, preferably 3 to 20. Suitable cations in the carboxymethylated ethoxylate of the formula $$R—(O—CH_2—CH_2)_n—O—CH_2—COOM$$

include sodium, potassium, lithium, ammonium, calcium, magnesium or hydrogen.

The emulsifiers employed are predominantly anionic so that breaking up of the corresponding stabilized emulsion takes place without any problems. The compounds are thermally stable, and compatible with salt-containing water within extremely wide limits (U.S. Pat. No. 4,457,373, which disclosure is incorporated by reference herein). Furthermore, they permit, by variation of the hydrophobic residue and of the degree of ethoxylation, optimum adaptation of the emulsifier to the oil to be transported and to the given salinity of the water. The latter, in most cases, is entrained from the deposit and suitably forms the aqueous phase of the emulsion to be transported.

In correspondence with their preparation, the carboxymethylated ethoxylates can contain unreacted ethoxylate alcohol starting material. Accordingly, a degree of carboxymethylation can be defined. The formulae $$R—(O—CH_2—CH_2)_n—O—CH_2COOM \text{ and}$$
$$R—(OCH_2—CH_2)_n—OH$$

thus designate a mixture containing varying amounts of unreacted ethoxylate. The degree of carboxymethylation generally is 40 to 100 wt. %, preferably 50 to 100 wt. %. Especially effective are mixtures having a degree of carboxymethylation of 85 to 100 wt. %. Such mixtures thus comprise anionic and nonionic tensides and are considered to be "carboxymethylated ethoxylates" in accordance with this invention.

The aforedescribed mixtures of anionic and nonionic tenside, or the purely anionic compounds (emulsifier), are soluble or at least dispersible without problems in the usual deposit waters.

In preliminary tests, the emulsifier to be used can be optimally adjusted in correspondence with its chemical structure to the respectively existing heavy oil-water system.

The tensides (emulsifiers) of a homologous series (cf. Table A) are dissolved in the respective water and mixed with the respective oil and, after briefly stirring with a blade-type mixer without application of high shear forces, can be tested for their emulsifying effect, and the stability of the emulsion can be determined. These are the usual preliminary routine tests conducted for this purpose. Evaluation of the emulsion can be repeated about 24 hours later, and, optionally, the viscosity measured in dependence on the shear rate. Since heavy oil emulsions are somewhat structurally viscous, a range of 10 to 100 $sec^{-1}$ is usually chosen for the shear rate, corresponding approximately to transportation through pipelines. A tenside is an optimum emulsifier if the amount required for emulsification is minimal.

The amount generally is 0.01 to 0.5%, especially 0.03–0.2% by weight, based on the amount of oil, which corresponds to 100–5,000 ppm, preferably 300–2,000 ppm. The emulsifier is added in metered amounts to the oil-water mixture for heavy oil liquefaction, either as a melt or as an aqueous solution or dispersion, or also can be added to the water which is then mixed with the oil. In this connection, the water is a more or less saline water produced together with the heavy oil, or it can be a cheaply available surface water, or also a mixture of both kinds of water. Since heavy-oil fields are frequently extracted by steam flooding, the salinity of the evolving water can fluctuate somewhat; this is not critical for the process of this invention.

Instead of dosing the emulsifier into the water, the emulsifier can also be added to the heavy oil proper, especially since the tenside class of this invention shows good oil solubility. In certain circumstances, it may be advantageous to use a small amount of a thinly fluid hydrocarbon mixture as the solubilizer. Mixing of the three components to form the emulsion, namely oil, water and emulsifier, can take place either directly at the drilled well or in or close to a collecting tank, or at any other point of the pipeline system. Viscous oils for use in this invention include all which are not of sufficiently low viscosity for satisfactory pipeline transport. This invention is applicable to all oil compositions and is effective over the full range of salinities encountered in the field, e.g., 0–25 wt. % of the usual salts, e.g., alkali metal and alkaline earth metal salts.

The mixture weight ratio of oil to water can vary within wide limits, e.g., 10:90 to 90:10. High oil contents are desirable for economical reasons. But very high oil contents in most cases also lead to relatively high-viscosity oil/water emulsions. The economical optimum, therefore, usually ranges at an oil content of 70% to 85%, depending on the system details.

Emulsification, as is known, is enhanced by mixing devices, such as stirrer installations, centrifugal pumps, static mixers, etc., which are used in case they are necessary. The thus-formed emulsion is conveyed through the pipeline system, which latter can comprise intermediate stations and interposed storage tanks. At the end point of the pipeline, the emulsion is conventionally broken up in a separator; in this connection, it may be advantageous to add one or more demulsifiers. The thus-dewatered crude oil is discharged and thereafter passed on to the refinery or to possible further transportation, for example by ship.

Unless indicated otherwise herein, all details of the emulsification, transport and demulsification are conventional, e.g., as disclosed in M. L. Mao and S. S. Marsden, The Journal of Canadian Petroleum Technology, 1977, April–June, page 54, which disclosure is incorporated by reference herein.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLES

In a glass vessel or polyethylene beaker having a capacity of about 200 ml, 75 g of Boskan oil (about 10° API, viscosity at 20° C. about 180,000 mPa·s) and respectively 25 g of the cited aqueous tenside solution, which furthermore contains a neutral electrolyte, are stirred together at room temperature by means of a simple blade-type agitator (about 100 rpm). If the added tenside is effective, and its amount sufficient, then an emulsion is produced having a uniform appearance. The mixture is then allowed to stand for about 24 hours at room temperature and the uniformity of the mixture is again examined; during this step, the mixture—if necessary—is stirred somewhat with a glass rod. If a readily fluid, uniform emulsion has formed, its viscosity is measured, as described above. The minimum emulsifier concentration (percent by weight, based on the oil quantity) of the respective tenside is recorded which is required for preparing an approximately stable emulsion. "Approximately stable" means herein that already a slight stirring with the glass rod suffices to reestablish the original uniformity, if the latter had been lost at all.

Then generally high efficacy of the carboxymethylated ethoxylates as heavy-oil emulsifiers is demonstrated with the aid of the examples, compiled in the tables below.

As shown in Table A using a low-salinity water as an example (1,500 ppm NaCl), the effectiveness of the tenside can be optimized by varying the chemical structure (changing the degree of ethoxylation). Carboxymethylated nonylphenol ethoxylates having a degree of ethoxylation of about 3.3 here exhibit the highest efficacy. The viscosity, with about 100 mPa·s at 20° C.—100 mPa·s at 37.7° C. is the requirement—is at a very low value.

In Table B the effect of the same tensides is investigated in the presence of a high-salinity water (50,000 ppm NaCl). The degree of ethoxylation of the most effective tensides is in this case between 5.5 and 6.0. The considerably increased efficacy as compared with the low-salinity conditions in Table A is a surprising feature.

As demonstrated in Table C, as compared with Table B, the degree of ethoxylation of the most effective carboxymethylated ethoxylates is changed by replacing the nonylphenol residue by dodecylphenol.

As demonstrated by Table D, as compared with Table A, substitution of the cation (hydrogen instead of sodium) also greatly affects the emulsifying properties of the tenside; here again, the structural variable is the degree of ethoxylation. This degree, for the optimum tenside, here is substantially higher, although lowering the salinity of the aqueous phase should actually lead to lowering of the degree of ethoxylation as well.

Table E illustrates the dependency of the emulsifier efficacy on the degree of carboxymethylation in a carboxymethylated nonylphenol ethoxylate. In this case, the effect of alkaline earth ions is likewise examined. The effectiveness greatly rises with an increasing degree of carboxymethylation. This also holds true in the presence of alkaline earth ions which, by the way, with a given high basic salinity, weaken the emulsifying effect to a greater extent than additional alkali halogenides in the same concentration.

Since heavy oil is frequently extracted by means of steam and hot-water flooding, a variable salinity must be expected. Table F shows a corresponding dilution series of salinity. It is shown that the carboxymethylated ethoxylate tested herein constitutes an effective emulsifier in very low concentrations over a wide salinity range of 10.2% to 1.2%, leading to readily flowing emulsions.

As is known, heavy oils differ greatly with respect to their composition. For this reason, tests were performed analogously to Table C, using another heavy oil. The latter has a density of 12° API and contains 30% aromatic, 20% naphthenic, as well as 50% paraffinic hydrocarbons. The viscosity at 20° C. is 70,000 mPa·s. As shown in Table G, readily fluid oil-in-water emulsions can be prepared with small additions of carboxymethylated ethoxylates. The degree of ethoxylation of the carboxymethylated nonylphenols, leading to a minimum of tenside concentration required, is here substantially higher than in case of the heavy oil investigated in Table C.

TABLE A

Minimum Emulsifier Concentration in Case of Carboxymethylated Nonylphenol Ethoxylate Sodium Salts (Degree of Carboxymethylation about 80%) in Dependence on the Degree of Ethoxylation; Salinity 1,500 ppm NaCl

| Example No. | EO Degree (mol/mol) | Minimum Concentration (%) | Viscosity at 20° C. (mPa.s) |
|---|---|---|---|
| 1 | 3 | 0.3 | 270 |
| 2 | 3.3 | 0.1 | 130 |
| 3 | 3.8 | 0.15 | — |
| 4 | 4.0 | 0.3 | 90 |
| 5 | 4.3 | 0.3 | 80 |
| 6 | 4.8 | >0.3 | — |
| 7 | 4.9 | >0.3 | — |

TABLE B

Minimum Emulsifier Concentration in Case of Carboxymethylated Nonylphenol Ethoxylate Sodium Salts (Degree of Carboxymethylation about 80%) in Dependence on the Degree of Ethoxylation; Salinity 50,000 ppm NaCl

| Example No. | EO Degree (mol/mol) | Minimum Concentration (%) | Viscosity at 20° C. (mPa.s) |
|---|---|---|---|
| 1 | 3 | 0.4 | 850 |
| 2 | 3.5 | 0.2 | — |
| 3 | 3.9 | 0.2 | 320 |
| 4 | 4.6 | 0.05 | 110 |
| 5 | 5.5 | 0.03 | — |
| 6 | 6.0 | 0.03 | 150 |
| 7 | 7.3 | 0.05 | 100 |
| 8 | 8.0 | 0.05 | 180 |

TABLE C

Minimum Emulsifier Concentration in Case of Carboxymethylated Dodecylphenol Ethoxylate Sodium Salts (Degree of Carboxymethylation about 80%) in Dependence on the Degree of Ethoxylation; Salinity 50,000 ppm NaCl

| Example No. | EO Degree (mol/mol) | Minimum Concentration (%) | Viscosity at 20° C. (mPa.s) |
|---|---|---|---|
| 1 | 5.0 | 0.2 | — |
| 2 | 6.0 | 0.1 | 140 |
| 3 | 7.0 | 0.08 | 130 |
| 4 | 8.0 | 0.05 | 110 |
| 5 | 9.0 | 0.05 | 90 |
| 6 | 10.0 | 0.075 | 170 |

TABLE D

Minimum Emulsifier Concentration in Case of Nonylphenol Ethoxylate Acetic Acid (Degree of Carboxymethylation about 80%); Salinity 500 ppm NaCl

| Example No. | EO Degree (mol/mol) | Minimum Concentration (%) | Viscosity at 20° C. (mPa.s) |
|---|---|---|---|
| 1 | 6.1 | >0.4 | — |
| 2 | 7.3 | >0.4 | — |
| 3 | 8.0 | 0.3 | 100 |
| 4 | 9.0 | 0.2 | 210 |
| 5 | 10.0 | 0.1 | 120 |
| 6 | 11.0 | 0.1 | — |
| 7 | 12.0 | 0.1 | 120 |
| 8 | 13.0 | 0.2 | — |
| 9 | 14.0 | 0.2 | 120 |

TABLE D-continued

Minimum Emulsifier Concentration in Case of Nonylphenol Ethoxylate Acetic Acid (Degree of Carboxymethylation about 80%); Salinity 500 ppm NaCl

| Example No. | EO Degree (mol/mol) | Minimum Concentration (%) | Viscosity at 20° C. (mPa.s) |
|---|---|---|---|
| 10 | 15.0 | >0.4 | — |
| 11 | 16.0 | >0.4 | — |

TABLE E

Minimum Emulsifier Concentration in Case of Carboxymethylated Nonylphenol Ethoxylate Sodium Salt with 6 Moles of EO/mol in Dependence on the Degree of Carboxymethylation; Salinity (a) 10% NaCl and (b) 10% NaCl + 0.5% $CaCl_2$

| Example No. | Degree of Carboxymethylation (%) | Minimum Concentration (%) | Viscosity at 20° C. (mPa.s) |
|---|---|---|---|
| 1 a | 50 | 0.3 | — |
| b | | 0.4 | 170 |
| 2 a | 66 | 0.18 | — |
| b | | 0.27 | — |
| 3 a | 80 | 0.10 | 200 |
| b | | 0.18 | 130 |
| 4 a | 98 | 0.05 | 170 |
| b | | 0.12 | 150 |
| 5 b | 100 | 0.10 | — |

TABLE F

Minimum Emulsifier Concentration in Case of a Carboxymethylated Nonylphenol Ethoxylate Sodium Salt with 6 Moles of EO/mol, Degree of Carboxymethylation 80% in Dependence on Salinity; Basic Salinity (100%) = 10% NaCl + 0.2% $CaCl_2$

| Example No. | Salilnity (%) | Minimum Concentration (%) | Viscosity at 20° C. (mPa.s) |
|---|---|---|---|
| 1 | 100 | 0.13 | 180 |
| 2 | 50 | 0.05 | 100 |
| 3 | 33 | 0.04 | 140 |
| 4 | 24 | 0.04 | 120 |
| 5 | 12 | 0.04 | 120 |

TABLE G

Minimum Emulsifier Concentration in Case of Carboxymethylated Nonylphenol Ethoxylate Sodium Salts (Degree of Carboxymethylation about 80%) in Dependence on the Degree of Ethoxylation; Salinity 50,000 ppm NaCl; Other Heavy Oil

| Example No. | EO Degree (mol/mol) | Minimum Concentration (%) | Viscosity at 20° C. (mPa.s) |
|---|---|---|---|
| 1 | 6 | >0.5 | — |
| 2 | 8 | 0.4 | — |
| 3 | 10 | 0.1 | 150 |
| 4 | 12 | 0.2 | 180 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for transporting a viscous heavy crude oil through a pipeline comprising transporting it in the form of an oil-in-water emulsion comprising effective amounts of the crude oil, water and an emulsifier, wherein the emulsifier is 40–100 wt. % of a carboxymethylated ethoxylate of the formula $$R—(O—CH_2—CH_2)_n—O—CH_2—COOM$$

and 60–0 wt. % of an ethoxylate of the formula $$R—(OCH_2CH_2)_n—OH$$

wherein

R is a $C_{5-16}$ alkyl phenyl or di ($C_{3-16}$ alkyl) phenyl group, n is 1–40 and M is an alkali metal or alkaline earth metal cation or ammonium.

2. A process of claim 1, wherein the emulsifier comprises 50–100 wt. % of the carboxymethylated ethoxylate.

3. A process of claim 1, wherein the emulsifier comprises 85–100 wt. % of the carboxymethylated ethoxylate.

4. A process of claim 1 wherein the amount of water in the emulsion is at least about 10 wt. %.

5. A process of claim 4 wherein the emulsifier concentration in the emulsion, based on the amount of oil, is 0.01–0.5% by weight.

6. A process of claim 5 wherein the amount of oil in the emulsion is 70–85 wt. %.

7. A process of claim 1 wherein n is 3–20.

8. A process of claim 5 wherein the emulsifier concentration is 0.03–0.2% by wt.

9. A process of claim 1 wherein the water in the emulsion is saline water.

10. A process of claim 3 wherein the emulsifier comprises essentially no ethoxylate.

11. A process of claim 1 further comprising, after the transporting step, breaking down the emulsion into separated crude oil and water.

* * * * *